US009226631B2

(12) United States Patent
Komae et al.

(10) Patent No.: US 9,226,631 B2
(45) Date of Patent: Jan. 5, 2016

(54) CYCLONE SEPARATOR AND VACUUM CLEANER

(75) Inventors: Sota Komae, Tokyo (JP); Tsuyoshi Maeda, Tokyo (JP); Junichiro Hoshizaki, Tokyo (JP); Tomoo Kobayashi, Saitama (JP); Akihiro Iwahara, Saitama (JP); Masayoshi Izuka, Saitama (JP); Tadashi Fukushima, Saitama (JP); Kenji Yanagisawa, Saitama (JP); Daisuke Kondo, Saitama (JP)

(73) Assignee: Mitsubishi Electric Corporation, Tokyo (JP)

( * ) Notice: Subject to any disclaimer, the term of this patent is extended or adjusted under 35 U.S.C. 154(b) by 650 days.

(21) Appl. No.: 13/575,364

(22) PCT Filed: Feb. 3, 2011

(86) PCT No.: PCT/JP2011/052243

§ 371 (c)(1),
(2), (4) Date: Oct. 4, 2012

(87) PCT Pub. No.: WO2011/096476

PCT Pub. Date: Aug. 11, 2011

(65) Prior Publication Data

US 2013/0025086 A1 Jan. 31, 2013

(30) Foreign Application Priority Data

Feb. 4, 2010 (JP) ..... 2010-023274

(51) Int. Cl.
*A47L 9/16* (2006.01)
*A47L 9/00* (2006.01)

(52) U.S. Cl.
CPC ..... *A47L 9/1625* (2013.01); *A47L 9/0081* (2013.01); *A47L 9/1683* (2013.01)

(58) Field of Classification Search
CPC ... A47L 9/1666; A47L 9/1683; A47L 9/1608; A47L 9/1691; A47L 9/1625; A47L 7/0028; A47L 7/0038; A47L 9/10; B04C 5/28; B04C 5/26
USPC ..... 15/350, 352, 353; 55/320, 418, 341, 55/345, 337
See application file for complete search history.

(56) References Cited

U.S. PATENT DOCUMENTS 4,593,429 A 6/1986 Dyson
6,896,720 B1 * 5/2005 Arnold et al. ..... 95/271

(Continued)

FOREIGN PATENT DOCUMENTS

CN 1296801 A 5/2001
EP 0 042 723 12/1981

(Continued)

OTHER PUBLICATIONS

Office Action dated Apr. 23, 2014 issued in the corresponding CN patent application No. 2011800081944 (and English translation).

(Continued)

*Primary Examiner* — Robert Scruggs
(74) *Attorney, Agent, or Firm* — Posz Law Group, PLC

(57) ABSTRACT

A cyclonic separator and a vacuum cleaner which efficiently separates dust, collect the dust without re-scattering it and make low noise are provided. In a primary cyclone portion 10, a primary swirl chamber 12 swirls air containing dust sucked from a primary inlet 11, and thereby, separates a first dust and a second dust from the air containing dust to collect them respectively in a zero-order dust case 114 which is provided at a side of the primary swirl chamber 12 and communicates with a zero-order opening portion 113 provided at a side wall, and a primary dust case 14 provided at a lower side of the primary swirl chamber 12. In a secondary cyclone portion 20, a secondary inlet 21 with an opening area smaller than that of a primary outlet body 15 sucks air exhausted from the primary outlet body 15, a secondary swirl chamber 22 swirls the first air to separate the second dust which is finer than the first dust from the first air to collect the second dust in a secondary dust case 24 provided at a lower side of the secondary swirl chamber 12. With regard to the cyclonic separator with such a configuration, the zero-order dust case 114 is formed to cover at least a part of the secondary cyclone portion 20.

15 Claims, 8 Drawing Sheets

(56) References Cited

U.S. PATENT DOCUMENTS

| | | | |
|---|---|---|---|
| 2002/0088078 | A1 | 7/2002 | Oh |
| 2004/0231305 | A1 | 11/2004 | Oh |
| 2005/0251951 | A1 | 11/2005 | Oh et al. |
| 2006/0123748 | A1 | 6/2006 | Boddy et al. |
| 2009/0031524 | A1 | 2/2009 | Courtney et al. |

FOREIGN PATENT DOCUMENTS

| | | | |
|---|---|---|---|
| JP | 58-067366 | A | 4/1983 |
| JP | 62-50141 | A | 10/1987 |
| JP | 06-063452 | A | 3/1994 |
| JP | 2002-503541 | A | 2/2002 |
| JP | 2002-209815 | A | 7/2002 |
| JP | 2003-070700 | A | 3/2003 |
| JP | 2003-204906 | A | 7/2003 |
| JP | 2004-229826 | A | 8/2004 |
| JP | 2004-344642 | A | 12/2004 |
| JP | 2005-323998 | A | 11/2005 |
| JP | 2006-508725 | A | 3/2006 |
| JP | 2008-541815 | A | 11/2008 |
| JP | 2008-541816 | A | 11/2008 |
| WO | WO 99/42198 | A1 | 8/1999 |
| WO | WO 2004/049889 | A1 | 6/2004 |
| WO | WO 2006/125945 | A1 | 11/2006 |
| WO | WO 2006-125946 | A1 | 11/2006 |

OTHER PUBLICATIONS

Office Action dated Aug. 12, 2014 issued in the corresponding JP patent application No. 2012-049465 (and English translation).

Office Action mailed on Jan. 21, 2014 in the corresponding JP application No. 2012-049465 (and partial English translation).

Notification of Transmittal of Translation of the International Preliminary Report on Patentability mailed Sep. 27, 2012 in the corresponding International application No. PCT/JP2011/052243 (English translation only).

International Search Report mailed on May 17, 2011 for the corresponding application No. PCT/JP2011/052243.

Office Action mailed Nov. 10, 2015 issued in corresponding JP patent application No. 2012-49465 (and partial English translation).

* cited by examiner

CYCLONE SEPARATOR AND VACUUM CLEANER

CROSS REFERENCE TO RELATED APPLICATIONS

This application is a U.S. national stage application of PCT/JP2011/052243 filed on Feb. 3, 2011, and claims priority to, and incorporates by reference, Japanese Patent Application No. 2010-023274 filed on Feb. 4, 2010.

TECHNICAL FIELD

The present invention relates to a cyclone separator that swirls air containing dust sucked from outside a vacuum cleaner to centrifugally separate dust from air and collect the dust, and a vacuum cleaner including the cyclone separator.

BACKGROUND ART

A conventional cyclone separator, particularly, a cyclone separator used in a vacuum cleaner or the like allows air containing dust sucked by an electric air blower to pass through a dust filter or a dust bag to collect dust in air. However, for a vacuum cleaner using such a cyclone separator, a dust bag needs to be regularly bought and mounted in a vacuum cleaner body, which is inconvenient and troublesome for a user.

To solve such a problem, a vacuum cleaner including a cyclone separator has been proposed that can separate dust from air using a centrifugal force or an inertial force to collect dust without using a dust bag that is a consumable. As a vacuum cleaner including such a cyclone separator, for example, a vacuum cleaner has been proposed in which an outer cyclone and an inner cyclone surrounded by the outer cyclone, which are provided concentrically, communicate with each other in series, thereby increasing dust separation efficiency of the cyclone separator (for example, see Patent Literatures 1 to 3).

CITATION LIST

Patent Literature

Patent Literature 1: Japanese Patent Publication No. 62-50141

Patent Literature 2: National Publication of International Patent Application No. 2008-541815

Patent Literature 3: National Publication of International Patent Application No. 2008-541816

SUMMARY OF INVENTION

Technical Problem

According to the conventional cyclone separators according to Patent Literatures 1 to 3, the plurality of swirl chambers are connected in series to increase dust separation efficiency of the cyclone separator. However, in such cyclone separators, an inner cyclone and an outer cyclone that are swirl chambers are concentrically provided, that is, a swirl chamber (inner cyclone) is covered with another swirl chamber (outer cyclone). Thus, a sound of dust swirling by a swirl flow in the inner cyclone rubbing an inner wall surface, and a sound of dust swirling by a swirl flow in the outer cyclone rubbing an inner wall surface are both generated, and no measures against noise have been taken.

The present invention is achieved to solve the problem as described above, and has an object to provide a cyclone separator that efficiently separates dust from air containing dust with low noise, and a vacuum cleaner including the cyclone separator.

Means for Solving the Problems

A cyclone separator according to the present invention has a primary cyclone portion including a primary inlet through which air containing dust sucked from outside enters, a primary swirl chamber that swirls the air containing dust sucked in from the primary inlet to separate dust from the air containing dust, a primary dust case that collects the dust separated by the primary swirl chamber from a primary opening portion provided in a lower part of the primary swirl chamber, and a primary outlet that discharges the air in the primary swirl chamber, a secondary cyclone portion including a secondary inlet through which air discharged from the primary outlet enters, a secondary swirl chamber that swirls the air sucked in from the secondary inlet to further separate dust from the air, a secondary dust case that collects the dust separated by the secondary swirl chamber from a secondary opening portion provided in the secondary swirl chamber, and a secondary outlet that discharges the air in the secondary swirl chamber, and a zero-order dust case that collects the dust separated by the primary swirl chamber from an opening portion provided in a side wall of the primary swirl chamber, wherein the zero-order dust case is placed so as to cover at least a part of the secondary cyclone portion.

Advantageous Effects of Invention

According to the cyclone separator of the present invention, the above configuration is adopted to efficiently separate dust from air containing dust and prevent noise.

BRIEF DESCRIPTION OF THE DRAWINGS

FIG. 13 is a C-C sectional view of the cyclone separator 50 shown in FIG. 10.

FIG. 14 is a D-D sectional view of the cyclone separator 50 shown in FIG. 13.

FIG. 15 is an E-E sectional view of the cyclone separator 50 shown in FIG. 13.

FIG. 18 is an exploded perspective view of the cyclone separator 50.

DESCRIPTION OF EMBODIMENT

Now, with reference to the drawings, a vacuum cleaner according to an embodiment of the present invention will be described.

Embodiment 1

Figure 1:
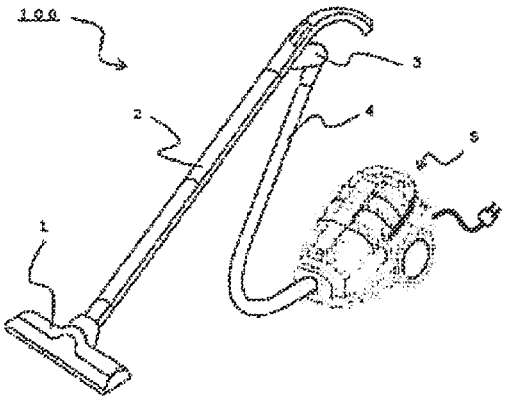
FIG. 1 is a perspective view showing an appearance of a vacuum cleaner according to the present invention

FIG. 1 is a perspective view showing an appearance of a vacuum cleaner according to the present invention. As shown in FIG. 1, the vacuum cleaner 100 includes a suction port body 1, a suction pipe 2, a connection pipe 3, a suction hose 4, and a cyclone cleaner body 5. The suction port body 1 sucks dust on a floor surface and air containing dust. One end of the straight cylindrical suction pipe 2 is connected to an outlet side of the suction port body 1. The other end of the suction pipe 2 is connected to one end of the connection pipe 3 which includes a handle having an operation switch for controlling an operation of the vacuum cleaner 100 and is slightly bent in the middle. To the other end of the connection pipe 3, one end of the flexible bellows suction hose 4 is connected. Further, to the other end of the suction hose 4, the cleaner body 5 is connected. A power cord is connected to the cleaner body 5, and the power cord is connected to an external power source to energize the cleaner body 5, and an electric air blower described later is driven to perform suction. The suction port body 1, the suction pipe 2, the connection pipe 3, and the suction hose 4 constitute a part of a suction path for introducing air containing dust from an outside to an inside of the cleaner body 5.

Figure 2:
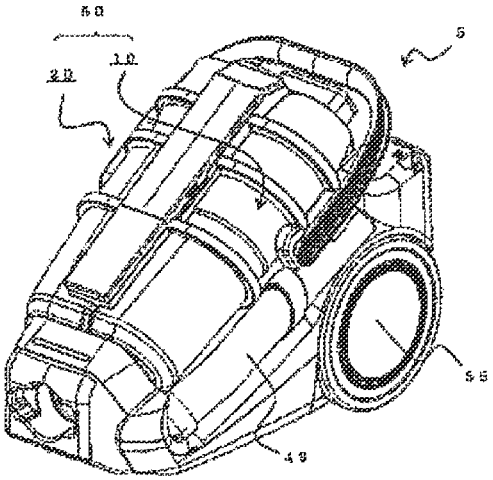
FIG. 2 is a perspective view of the cleaner body 5 of the vacuum cleaner in FIG. 1.
Figure 3:
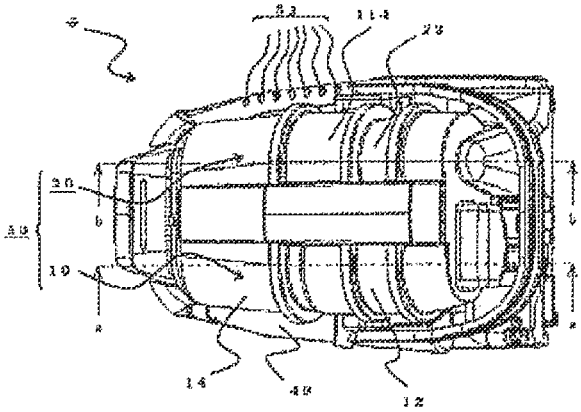
FIG. 3 is a plane view of the cleaner body 5 shown in FIG. 1.
Figure 4:
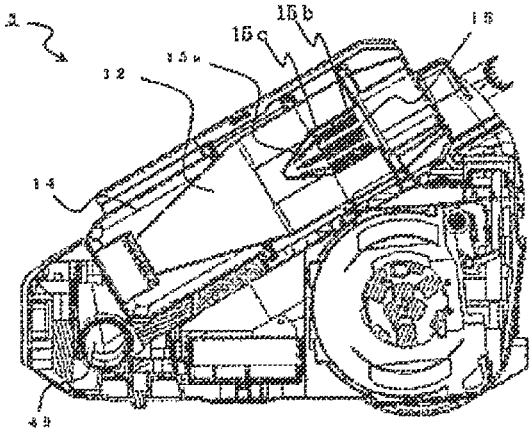
FIG. 4 is an a-a sectional view of the cleaner body 5 in FIG. 2.
Figure 5:
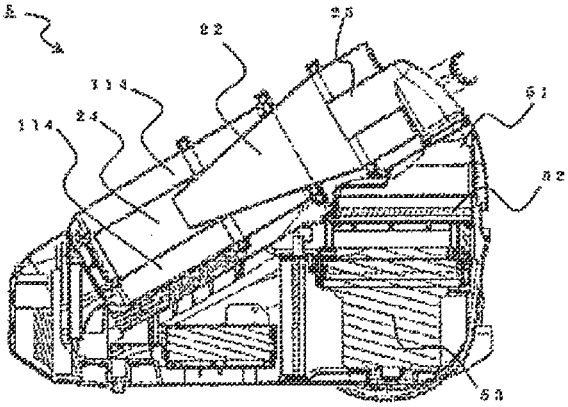
FIG. 5 is a b-b sectional view of the cleaner body 5 shown in FIG. 2.
Figure 6:
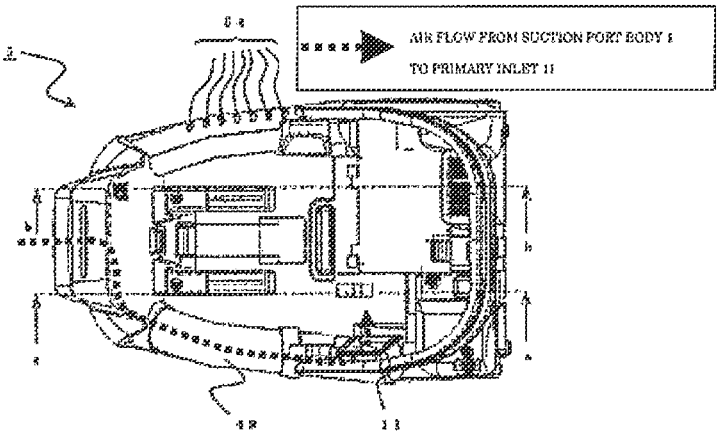
FIG. 6 is a top view of the cleaner body 5 with a cyclone separator 50 being removed.
Figure 7:
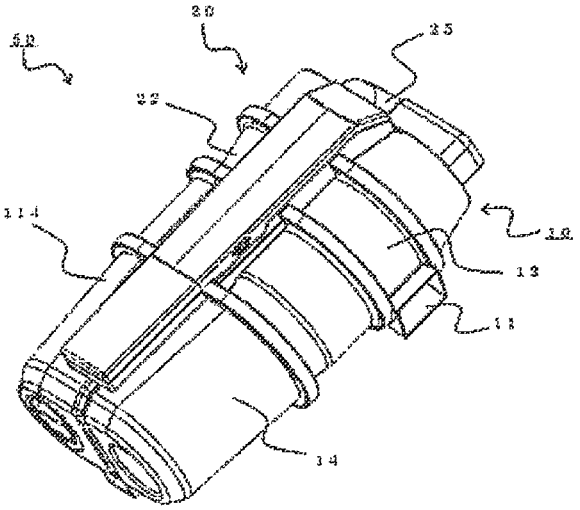
FIG. 7 is a perspective view of showing an appearance of the cyclone separator 50.
Figure 8:
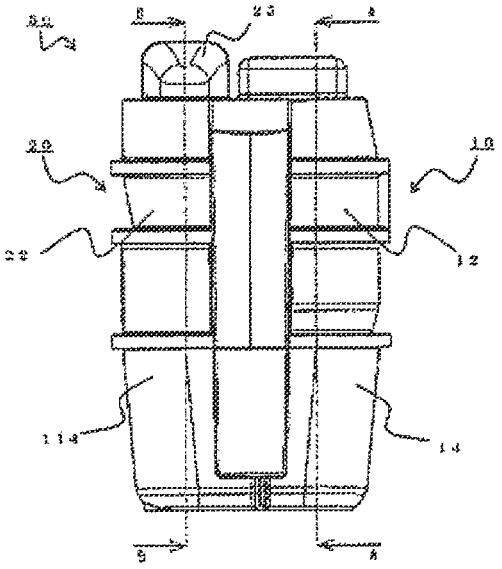
FIG. 8 is a front view of the cyclone separator 50.
Figure 9:
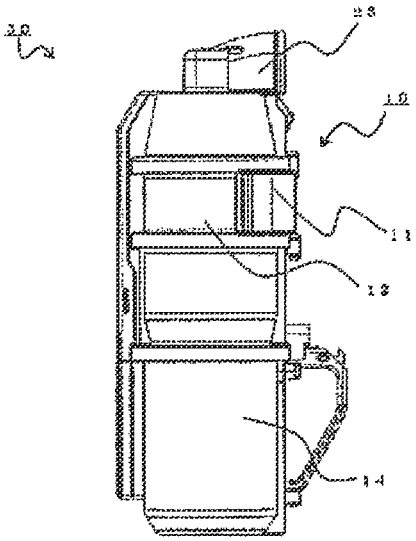
FIG. 9 is a left side view of the cyclone separator 50.
Figure 10:
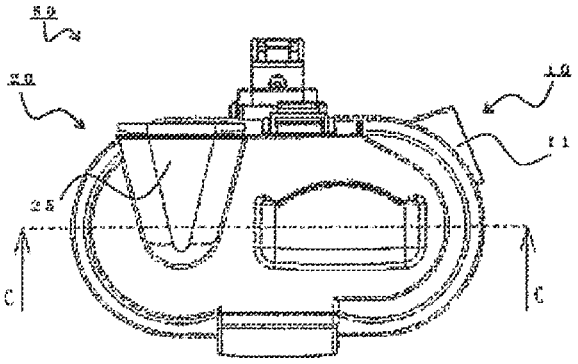
FIG. 10 is a top view of the cyclone separator 50.
Figure 11:
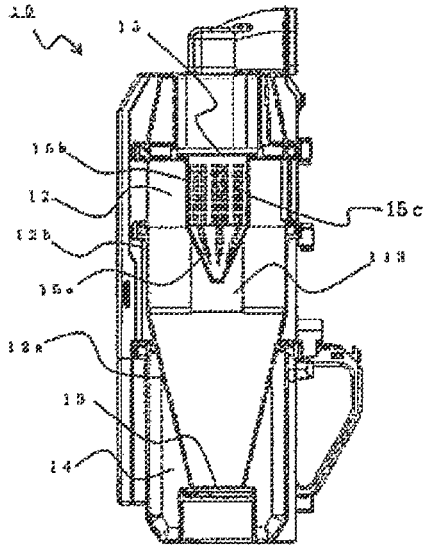
FIG. 11 is an A-A sectional view of the cyclone separator 50 shown in FIG. 8.
Figure 12:
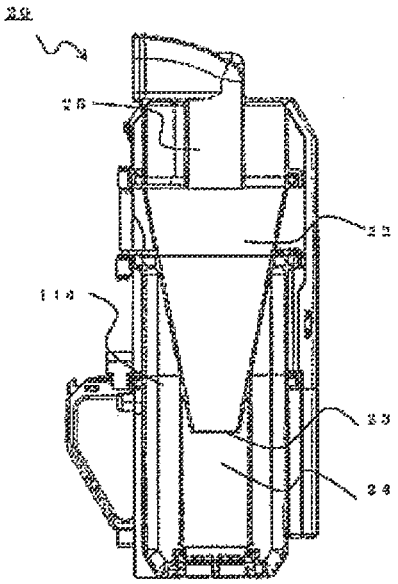
FIG. 12 is a B-B sectional view of the cyclone separator 50 shown in FIG. 8.
Figure 1:
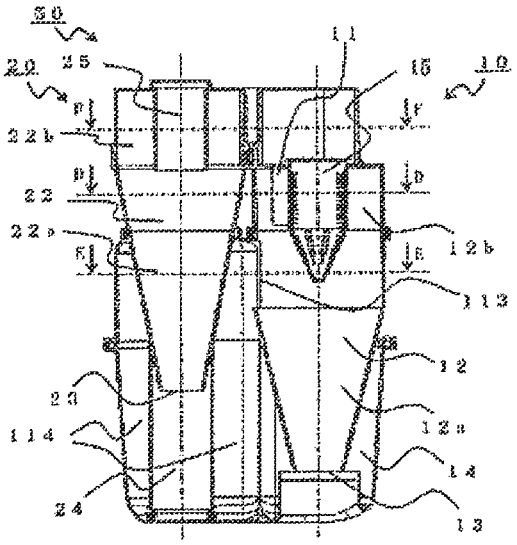
Figure 1:
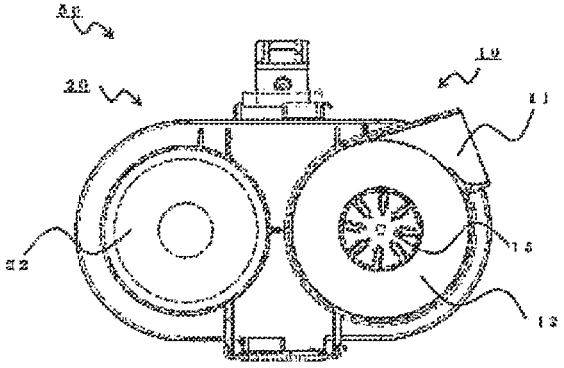
Figure 1:
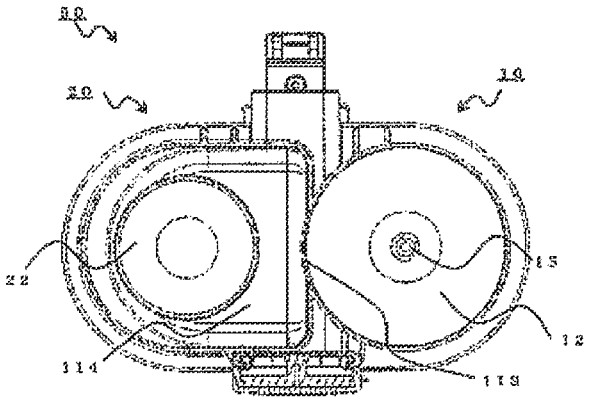
Figure 16:
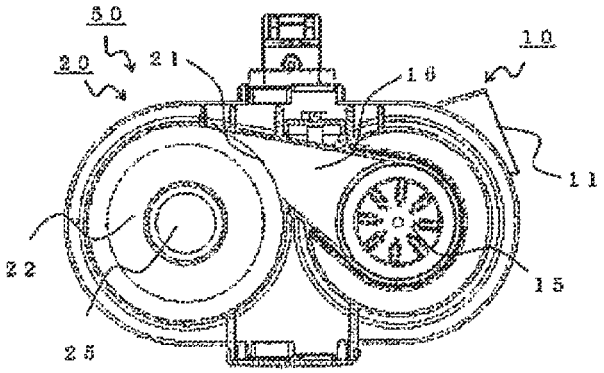
FIG. 16 is an F-F sectional view along the arrow F-F of the cyclone separator 50 in FIG. 13.
Figure 17:
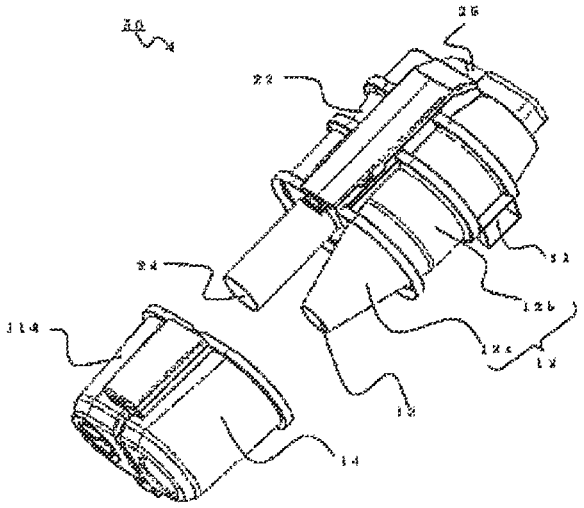
FIG. 17 is a perspective view in disposal of dust of the cyclone separator 50.
Figure 1:
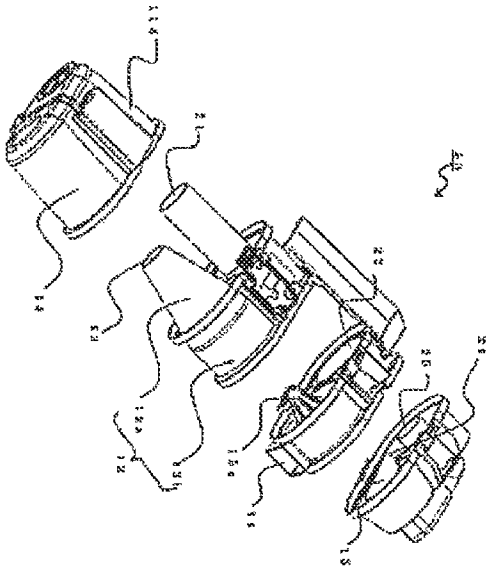

FIG. 2 is a perspective view of the cleaner body 5 of the vacuum cleaner in FIG. 1, FIG. 3 is a plane view of the cleaner body 5 shown in FIG. 1, FIG. 4 is an a-a sectional view of the cleaner body 5 in FIG. 2, FIG. 5 is a b-b sectional view of the cleaner body 5 shown in FIG. 2, FIG. 6 is a top view of the cleaner body 5 with a cyclone separator 50 being removed, FIG. 7 is a perspective view of showing an appearance of the cyclone separator 50, and FIG. 8 is a front view of the cyclone separator 50. FIG. 9 is a left side view of the cyclone separator 50, and FIG. 10 is a top view of the cyclone separator 50. FIG. 11 is an A-A sectional view of the cyclone separator 50 shown in FIG. 8, FIG. 12 is a B-B sectional view of the cyclone separator 50 shown in FIG. 8, FIG. 13 is a C-C sectional view of the cyclone separator 50 shown in FIG. 10, FIG. 14 is a D-D sectional view of the cyclone separator 50 shown in FIG. 13, FIG. 15 is an E-E sectional view of the cyclone separator 50 shown in FIG. 13, FIG. 16 is an F-F sectional view along the arrow F-F of the cyclone separator 50 in FIG. 13, FIG. 17 is a perspective view in disposal of dust of the cyclone separator 50, and FIG. 18 is an exploded perspective view of the cyclone separator 50.

As shown in the drawings, the vacuum cleaner body 5 includes a suction air duct 49, a cyclone separator 50, an exhaust air duct 51, a filter 52, an electric air blower 53, an exhaust port 54, and wheels 55. One end of the suction air duct 49 is connected to the suction hose 4 shown in FIG. 1 and provided along an outer wall of a side surface of a primary cyclone portion 10, and the other end of the suction air duct 49 is connected to a primary inlet 11 of the primary cyclone portion 10 that constitutes a part of the cyclone separator 50. The cyclone separator 50 is connected to the exhaust air duct 51 placed in a rear part of the vacuum cleaner body 5 by a secondary outlet 25 of a secondary cyclone portion 20 that constitutes the cyclone separator 50 similarly to the primary cyclone portion 10. The exhaust air duct 51 is connected through the filter 52 to the electric air blower 53 placed in the rear part of the vacuum cleaner body 5 similarly to the exhaust air duct 51. The exhaust port 54 constituted by a plurality of holes is formed in a side wall on a side opposite to a side with the suction air duct 49 placed.

A detailed configuration of the cyclone separator 50 will be described.

The cyclone separator 50 includes the primary cyclone portion 10, and the secondary cyclone portion 20 provided in parallel with the primary cyclone portion 10 and connected to a downstream side of the primary cyclone portion 10.

First, with reference to FIGS. 11 and 13, a configuration of the primary cyclone portion 10 will be described.

The primary cyclone portion 10 includes the primary inlet 11, a primary swirl chamber 12, a zero-order opening portion 113, a primary opening portion 13, a zero-order dust case 114, a primary dust case 14, a primary outlet body 15, and a primary discharge pipe 16.

As shown in FIG. 13, a side wall of the primary swirl chamber 12 is constituted by a substantially cylindrical primary cylindrical portion 12*b*, a substantially conical primary conical portion 12*a* formed under the primary cylindrical portion 12*b*, and having a tip portion forming a part of a side wall surface of the primary swirl chamber 12 and having a decreasing diameter toward a tip, and the primary opening portion 13 formed in the tip of the primary conical portion 12*a*.

The zero-order opening portion 113 is formed in a part of the primary cylindrical portion 12*b*, opens in a lower position than the primary inlet 11, and communicates with the zero-order dust case 114. The primary dust case 14 is formed so that an upper end thereof extends upward of the primary opening portion 13 to compress dust collected in the primary dust case 14.

As shown in FIG. 11, the primary outlet body 15 includes a substantially cylindrical hollow cylindrical portion 15*b*, and a conical portion 15*a* provided under the cylindrical portion 15*b* and having a decreasing diameter toward a tip (lower side in FIG. 11), and a primary outlet 15*c* constituted by many holes is formed in side walls of the cylindrical portion 15*b* and the conical portion 15*a*. A lowest portion of the primary outlet 15*c* is placed in a lower position than the primary swirl inlet 11.

Next, with reference to FIGS. 10, 12, 13 and 16, a configuration of the secondary cyclone portion 20 will be described.

The secondary cyclone portion 20 includes a secondary inlet 21, a secondary swirl chamber 22, a secondary opening portion 23, a secondary dust case 24, a secondary outlet 25, and a secondary discharge pipe 26.

The secondary swirl chamber 22 includes a substantially cylindrical secondary cylindrical portion 22*b* that forms a side wall surface of the secondary swirl chamber 22, a substantially conical secondary conical portion 22*a* provided under the secondary cylindrical portion 22*b* and having a decreasing diameter toward a tip, and a secondary opening portion 23 formed in a tip (lower end) of the secondary conical portion 22*a*. As shown in FIG. 13, a tip side of the secondary conical portion 22*a* protrudes into the secondary dust case 24.

The zero-order dust case 114 described above is placed to surround the secondary dust case 24 and a part of the secondary swirl chamber 22 protruding into the secondary dust case 24, and the primary dust case 14 and the secondary dust case 24 are formed as one component.

In the above configuration, the primary discharge pipe 16 is provided to communicate between the primary outlet 15*c* and the secondary inlet 21, and the secondary discharge pipe 26 is provided to communicate between the secondary outlet 25*c* and the exhaust air duct 51. Thus, the cleaner body 5 passes air containing dust entering inside through the suction port body 1, the suction pipe 2, the connection pipe 3, and the suction hose 4 sequentially through the suction air duct 49, the primary inlet 11, the primary swirl chamber 12, the primary outlet 15*c*, the primary discharge pipe 16, the secondary inlet 21, the secondary swirl chamber 22, the secondary outlet 25, and the secondary discharge pipe 26 to clean the air, and discharges the air through an exhaust path constituted by the exhaust air duct 51, the filter 52, the electric air blower 53, and the exhaust port 54 to the outside of the cleaner body 5.

Next, an outline of an operation of the vacuum cleaner according to Embodiment 1 will be described.

When power is supplied to the electric air blower 53 by a user operating an operation portion (not shown) and the vacuum cleaner 100 starts driving, air containing dust is sucked from the suction port body 1 by a suction force of the electric air blower 53, flows through a suction path sequentially through the suction pipe 2, the connection pipe 3, and the suction hose 4, then flows along an arrowed broken line in FIG. 6, and enters the primary inlet 1 of the primary cyclone portion 10. The air containing dust entering the primary inlet 11 enters along a side wall of the primary cylindrical portion 12*b* of the primary swirl chamber 12 to form a swirl air flow, which flows downward of the primary swirl chamber 12 by its path structure and gravity while forming a forced vortex region near a central axis of the primary swirl chamber 12 and a quasifree vortex region on an outer peripheral side thereof.

At this time, a centrifugal force is applied to dust in the swirling air containing dust, and separates the air containing dust into dust and air. Among the dust separated by the centrifugal force, dust having high specific gravity (for example, large sand or pebbles, hereinafter referred to as dust A) flies from the zero-order opening portion 113 provided in the wall surface of the primary swirl chamber 12 into the zero-order dust case 114 and is collected. The dust A collected in the zero-order dust case 114 has relatively high specific gravity as described above, is thus not easily re-scattered but is accumulated on a bottom in the zero-order dust case 114.

On the other hand, air containing dust that has not been collected in the zero-order dust case 114 swirls and flows downward of the primary swirl chamber 12, that is, flows from the primary cylindrical portion 12*b* toward the primary conical portion 12*a*. As the swirl flow reaching the primary conical portion 12*a* descends, a swirl radius (that is, a diameter of the primary conical portion 12*a*) decreases, thereby increasing a swirl speed. Thus, dust (for example, cotton dust or fine lightweight sand, hereinafter referred to as dust B) having lower specific gravity than the dust A can be separated by a centrifugal force, and the dust B thus separated is collected from the primary opening portion 13 into the primary dust case 14 and accumulated.

The primary dust case 14 is formed into a D shape to form stagnation of air in a corner portion of the D shape, and the stagnation allows dust to be easily accumulated.

Meanwhile, air after removal of the dust A and the dust B from the air containing dust ascends along the central axis of the cylindrical portion 12*b* of the primary swirl chamber 12 in the primary cyclone portion 10, passes through the primary outlet 15*c* provided in the conical portion 15*a* and the cylindrical portion 15*b* of the primary outlet body 15, and flows from the primary discharge pipe 16 through the secondary inlet 21 and enters the secondary cyclone portion 20. The air entering the secondary inlet 21 enters substantially horizontally along a side wall of the secondary cylindrical portion 22*b* of the secondary swirl chamber 22 to form a swirl air flow, which flows downward by its path structure and gravity while forming a forced vortex region near a central axis of the secondary swirl chamber 22 and a quasifree vortex region on an outer peripheral side thereof. The exhausted air then descends in the secondary conical portion 22*a* of the secondary swirl chamber 22 and then ascends, and is exhausted through the secondary outlet 25 to the outside.

Comparing diameters of the swirl chambers near the outlets (that is, near the primary outlet 15*c* and the secondary outlet 25) of the cyclone portions, the diameter of the swirl chamber in the secondary cyclone portion 20 is smaller. Further, an opening area of the secondary outlet 25 is smaller than an opening area of the primary inlet 11 so that a swirl speed in the swirl chamber is higher in the secondary cyclone portion 20 than in the primary cyclone portion 10. Thus, fine dust that has not been collected by the primary cyclone portion 10 can be collected in the secondary dust case 24 in the secondary cyclone portion 20.

As described above, the primary outlet 15*c* is constituted by many micropores provided in the cylindrical portion 15*b* and the conical portion 15*a*.

This can prevent passage of dust larger than an opening of the primary outlet 15*c* from the air containing dust flowing from the primary cyclone portion 10 to the secondary cyclone portion 20. Also, the primary outlet 15*c* is provided in the side walls of the cylindrical portion 15*b* and the conical portion 15*a*, and thus a swirl air flow flowing around the primary outlet 15*c* removes dust clogging the primary outlet 15*c*, thereby preventing dust from clogging the primary outlet 15*c*. Further, a lower part of the primary outlet body 15 has a conical shape, and thus an ascending flow from below in the primary swirl chamber 12 can be smoothly discharged, thereby reducing pressure loss. Even if a very long thread-like dust such as hair twists around the conical portion 15*a*, the conical shape of the conical portion 15*a* facilitates removal of the dust.

As such, the dust A on which the centrifugal force acts relatively satisfactorily can be reliably collected in the zero-order dust case 114, and the dust B on which the centrifugal force acts less satisfactorily than the dust A can be collected in the primary dust case 14.

Percentages of dust contained in the air containing dust sucked by the vacuum cleaner generally decrease in order of the dust A, the dust B, and fine dust. Thus, the zero-order dust case 114 that collects the dust A has a larger volume than the other dust cases, and the secondary dust case 24 that collects the fine dust has a smaller volume than the other dust cases, thereby providing a more compact cyclone separator.

Next, with reference to FIGS. 13, 14, 15 and 17, measures against noise will be described.

As described above, the secondary cyclone portion 20 has higher dust collection efficiency than the primary cyclone portion 10 because of having a higher swirl speed of an air flow. However, the high swirl speed increases noise due to an air flow sound generated by swirling of the air flow or a frictional sound between dust swirling by the air flow and an inner wall surface of a swirl portion. Thus, the secondary cyclone portion 20 with a higher swirl speed of the air flow has higher dust collection efficiency than the primary cyclone portion 10, but generates higher noise than the primary cyclone portion 10.

Meanwhile, comparing amounts of air flows entering the primary dust case 14 provided in the primary cyclone portion 10 and the zero-order dust case 114, for the zero-order dust case 114, in a swirl direction of an air flow of air containing dust entering through the primary inlet 11, the zero-order opening portion 113 that communicates with the zero-order duct case 114 is formed in a wall surface of the primary swirl chamber 12 in a tangential direction of the air flow of the air containing dust, thereby minimizing entry of the air flow into the zero-order dust case 114. On the other hand, for the primary dust case 14 provided below the primary cyclone portion 10 collects dust separated by a centrifugal force of the air flow of the swirling air containing dust, and also a downward pressing force by the air flow, thereby increasing entry of the air flow as compared to the zero-order dust case 114. Thus, lower noise is generated by entry of the air flow, and a smaller friction sound is generated when dust rubs against the wall surface in the zero-order dust case 114 than in the primary dust case 14.

Thus, as shown in FIGS. 8 and 13, the zero-order dust case 114 covers at least a part of the secondary cyclone portion 20 to provide a region having an air layer with the least sound generation in the cyclone separator 50 and at least one wall surface between the secondary cyclone portion 20 that generates the largest sound and an outer space where a user exists. Specifically, the zero-order dust case 114 is provided to cut off a sound generated from the secondary cyclone portion 20.

This can prevent noise from being generated from the cyclone separator 50.

As shown in FIG. 13, the primary outlet 15*c* is formed in the primary outlet body 15 protruding into the primary swirl chamber 12, and a tip portion at a lowermost part of the primary outlet body 15 is located to face an opening surface of the primary inlet 11 or in a lower position than the opening surface. Thus, a tangential force and also a downward force are applied to a swirl flow generated by the air containing dust entering through the primary inlet 11, and dust is easily guided downward. This increases collection performance of dust into the primary dust case 14 placed below the primary swirl chamber 12.

Also as shown in FIG. 13, the lowermost part of the primary outlet 15 may be located to face an opening surface of the zero-order opening portion 113 or a lower position than the opening surface. Thus, an angle in a swirl direction of the air containing dust entering through the primary inlet 11 is directed downward of the zero-order opening portion 113, and thus the air flow easily swirls below the opening surface of the zero-order opening portion 113. This reduces an amount of air containing dust directly entering the zero-order dust case 114. Specifically, agitation of dust in the zero-order dust case 114 is reduced to further reduce a frictional sound. Also, an amount of air flow swirling in the zero-order dust case 114 is reduced to reduce an air flow sound.

As such, the configuration to reduce an amount of noise generated in the zero-order dust case 114 is provided to further reduce noise leaking outside from the cyclone separator 50.

Also, as shown in FIG. 13, a part of the secondary swirl chamber 12 with the largest frictional sound between the dust and the wall surface in the secondary cyclone portion 20 is covered with the zero-order dust case 114 with the smallest frictional sound between the dust and the wall surface in the cyclone separator 50. Thus, an object with a small rubbing sound covers an object with a large rubbing sound.

Thus, air in the zero-order dust case absorbs large noise generated from the secondary swirl chamber 12, thereby considerably effectively preventing noise and reducing noise of the entire cyclone separator 50.

Also, as shown in FIG. 15, the zero-order opening portion 113 is not formed in a region where a tangential direction of a swirl flow in the primary swirl chamber 12 is substantially parallel to a line connecting a center of the primary swirl chamber 12 and a center of the secondary swirl chamber 22. This can prevent the swirl flow from directly entering the zero-order opening portion 113. This reduces entry of air flow into the zero-order dust case 114, and reduces agitation of dust in the zero-order dust case, thereby further reducing frictional sound between the dust and the wall surface in the zero-order dust case 114. This prevents sound generated from the secondary cyclone portion 20 from leaking outside the cyclone separator 50 to further prevent noise.

A part of the primary swirl chamber 12 with the largest frictional sound between the dust and the wall surface in the primary cyclone portion 10 shown in FIG. 13 may be covered with the zero-order dust case 114 with the smallest frictional sound between the dust and the wall surface in the primary cyclone portion 10. Specifically, the primary conical portion 12*a* is provided under the primary cylindrical portion 12*b* of the primary swirl chamber 12, and a tip portion has a substantially conical shape with a decreasing diameter toward a tip, and thus a direction of the swirl flow in the primary swirl chamber 12 is bent when descending from the primary cylindrical portion 12*b* to the primary conical portion 12*a*. Thus, dust such as sand or pebbles in air strongly hit the primary conical portion 12*a*. Thus, a rubbing sound of air and a hitting sound of sand or pebbles add up to generate high noise. On the other hand, the zero-order dust case 114 generates a very small rubbing sound as described above.

The zero-order dust case 114 covers a part of the primary swirl chamber 12, and thus an object with a small rubbing sound covers an object with a large rubbing sound.

This can effectively prevent sound and reduce noise of the entire cyclone separator 50.

Similarly, a part of the secondary swirl chamber 22 with the largest frictional sound between the dust and the wall surface in the secondary cyclone portion 20 shown in FIG. 13 may be covered with the secondary dust case 24 with the smallest frictional sound between the dust and the wall surface in the secondary cyclone portion 20. Specifically, the secondary conical portion 22*a* is provided under the secondary cylindrical portion 22*b* of the secondary swirl chamber 22, and a tip portion has a substantially conical shape with a decreasing diameter toward a tip, and thus a direction of the swirl flow in the secondary swirl chamber 22 is bent when descending from the secondary cylindrical portion 22*b* to the secondary conical portion 22*a*. Thus, dust such as sand or pebbles in air strongly hit the secondary conical portion 22*a*. Thus, a rubbing sound of air and a hitting sound of sand or pebbles add up to generate high noise. On the other hand, the secondary dust case 24 is provided below the secondary conical portion 22*a*, and when the swirl flow having the highest speed in the secondary opening portion 23 at the tip of the secondary conical portion 22*a* enters the secondary dust case 24 having a larger sectional area from the secondary opening portion 23, a rubbing sound further decreases in the secondary dust case 24 with decreasing speed.

The secondary dust case 24 covers a part of the secondary swirl chamber 22, and thus an object with a small rubbing sound covers an object with a large rubbing sound. This reduces noise of the entire cyclone separator 50.

As shown in FIGS. 13 and 14, the zero-order dust case 114 that surrounds the secondary dust case 24 and the secondary dust case 24 both are cylinders having a substantially circular section. Thus, the dust cases are substantially concentrically placed to equalize the speed of the air flow in the zero-order dust case 114 to prevent turbulence of the flow. This equalizes rubbing or collision between the dust and the wall surface, and thus prevents noise due to uneven rubbing or collision between the dust and the wall surface as compared to a case where the dust cases are not concentrically placed, thereby further increasing a noise preventing effect.

Further, the secondary dust case 24 may extend from the secondary opening portion at the tip of the secondary conical portion 22*a* of the secondary swirl chamber 22. At this time, the secondary opening portion at the tip of the secondary conical portion 22*a* of the secondary swirl chamber 22 is connected to the secondary dust case 24 in the axial direction of the secondary conical portion 22*a*, and at least a part of a wall side of the secondary dust case 24 facing the secondary opening portion is constituted by the secondary conical portion. At least a part of the secondary conical portion 22*a* is covered with the zero-order dust case, and the part of the secondary conical portion 22*a* covered with the zero-order dust case 114 faces the zero-order opening portion 113.

Thus, when dust enters through the zero-order opening portion 113, the dust can be brought into contact with the cone to provide a speed component in the axial direction and a speed component in an extending direction of the dust case, thereby allowing the dust to be fed to a deep lower part of the dust case.

As described above, the primary outlet 15*c* communicates with the secondary inlet 21, and thus the secondary cyclone portion 20 is connected downstream of the primary cyclone portion 10 in series. Thus, substantially the same amount of air enters the primary cyclone portion 10 and the secondary cyclone portion 20. At this time, a sectional area of the primary inlet 11 shown in FIG. 16 is larger than a sectional area of the secondary inlet 21, and thus an air speed in the primary cyclone portion 10 can be lower than an air speed in the secondary cyclone portion 20. Thus, a rubbing sound between the dust and the wall surface generated in the zero-order dust case can be smaller than a rubbing sound between the dust and the wall surface generated in the secondary dust case to reduce noise.

Also, the primary swirl chamber 12 and the secondary swirl chamber 22 shown in FIGS. 13 and 17 may have different average diameters. As described above, the sectional area of the primary inlet 11 is larger than the sectional area of the secondary inlet 21 to provide different air speeds in the primary cyclone portion 10 and the secondary cyclone portion 20. Thus, the primary swirl chamber 12 and the secondary swirl chamber 22 have different average diameters so that the air flow can swirl at different speeds of rotation in the primary swirl chamber 12 and the secondary swirl chamber 22, thereby generating sounds in different frequency domains from the swirl chamber, and preventing resonance of sounds.

In Embodiment 1, the primary outlet 15*c* is formed in the primary outlet body 15 protruding into the swirl chamber 12, but not limited to this, the primary outlet 15*c* may be formed in an opening portion that communicates with the secondary inlet 21.

INDUSTRIAL APPLICABILITY

As described above, the cyclone separator and the vacuum cleaner according to the present invention can be applied to a cyclone separator that swirls air containing dust sucked from outside a vacuum cleaner to centrifugally separate dust from air and collect the dust, and a vacuum cleaner including the cyclone separator.

DESCRIPTION OF SYMBOLS

1 suction port body, 2 suction pipe, 3 connection pipe,
4 suction hose, 5 cleaner body, 10 primary cyclone portion,
11 primary inlet, 12 primary swirl chamber, 12*a* primary conical portion,
12*b* primary cylindrical portion, 13 primary opening portion,
14 primary dust case, 15 primary outlet body, 15*a* conical portion,
15*b* cylindrical portion, 15*c* primary outlet, 20 secondary cyclone portion,
21 secondary inlet, 22 secondary swirl chamber,
22*a* secondary conical portion, 22*b* secondary cylindrical portion,
23 secondary opening portion, 24 secondary dust case,
25 secondary outlet, 49 suction air duct, 50 cyclone separator,
51 exhaust air duct, 52 filter, 53 electric air blower,
54 exhaust port, 55 wheel, 100 vacuum cleaner,
113 zero-order opening portion, 114 zero-order dust case.

The invention claimed is:

1. A cyclone separator comprising:

a primary cyclone portion including a primary inlet through which air containing dust sucked from outside enters, a primary swirl chamber that swirls the air containing dust sucked in from the primary inlet to separate dust from the air containing dust, a primary dust case that collects the dust separated by the primary swirl chamber from a primary opening portion provided in a lower part of the primary swirl chamber, and a primary outlet that discharges the air in the primary swirl chamber; and a secondary cyclone portion including a secondary inlet through which air discharged from the primary outlet enters, a secondary swirl chamber that swirls the air sucked in from the secondary inlet to further separate dust from the air, a secondary dust case that collects the dust separated by the secondary swirl chamber from a secondary opening portion provided in the secondary swirl chamber, and a secondary outlet that discharges the air in the secondary swirl chamber, wherein the primary cyclone portion includes a zero-order dust case that collects the dust separated by the primary swirl chamber from an opening portion provided in a side wall of the primary swirl chamber, and the zero-order dust case is placed so as to abut and cover at least a part of the secondary swirl chamber in the secondary cyclone portion.

2. The cyclone separator according to claim 1, wherein the opening portion is provided in a side wall portion of the primary swirl chamber where a tangential direction of a swirl flow in the primary swirl chamber is not parallel to a line connecting a central axis of the primary swirl chamber and a central axis of the secondary swirl chamber.

3. The cyclone separator according to claim 1, wherein the primary outlet is formed in a side wall of a primary outlet body protruding into the swirl chamber, and a tip of the primary outlet body is placed in a lower position than the primary inlet.

4. The cyclone separator according to claim 3, wherein a tip portion of the primary outlet body is located to face an opening surface of the opening portion or in a lower position than the opening surface.

5. The cyclone separator according to claim 1, wherein a sectional area of the primary inlet is larger than a sectional area of the secondary inlet.

6. The cyclone separator according to claim 1, wherein the primary swirl chamber in the primary cyclone portion and the secondary swirl chamber in the secondary cyclone portion have different average diameters.

7. A vacuum cleaner comprising a cyclone separator according to claim 1.

8. A cyclone separator comprising:

a primary inlet configured to suck in air containing dust from outside the cyclone separator;

a primary swirl chamber configured to swirl the air containing dust sucked in from the primary inlet to separate first dust particles and second dust particles from the air containing dust;

a zero-order dust case configured to collect the first dust particles separated by the primary swirl chamber through an opening portion provided in a side wall of the primary swirl chamber;

a primary dust case configured to collect the second dust particles separated by the primary swirl chamber through a primary opening portion provided in a lower part of the primary swirl chamber;

a primary outlet configured to discharge the air in the primary swirl chamber;

a secondary inlet configured to receive air discharged from the primary outlet;

a secondary swirl chamber configured to swirl the air sucked in from the secondary inlet to separate third dust particles from the air;

a secondary dust case configured to collect the third dust particles separated by the secondary swirl chamber through a secondary opening portion provided in the secondary swirl chamber; and a secondary outlet configured to discharge the air from the secondary swirl chamber, wherein the zero-order dust case is placed so as to abut and cover at least a part of the secondary swirl chamber in the secondary cyclone portion.

9. The cyclone separator according to claim 8, wherein the opening portion is provided in a side wall portion of the primary swirl chamber where a tangential direction of a swirl flow in the primary swirl chamber is not parallel to a line connecting a central axis of the primary swirl chamber and a central axis of the secondary swirl chamber.

10. The cyclone separator according to claim 8, wherein the primary outlet is formed in a side wall of a primary outlet body protruding into the swirl chamber, and a tip of the primary outlet body is placed in a lower position than the primary inlet.

11. The cyclone separator according to claim 10, wherein the tip of the primary outlet body is located to face an opening surface of the opening portion or in a lower position than the opening surface.

12. The cyclone separator according to claim 8, wherein a sectional area of the primary inlet is larger than a sectional area of the secondary inlet.

13. The cyclone separator according to claim 8, wherein the primary swirl chamber in the primary cyclone portion and the secondary swirl chamber in the secondary cyclone portion have different average diameters.

14. The cyclone separator according to claim 8, wherein the first dust particles have a greater specific gravity than the second dust particles.

15. A vacuum cleaner comprising a cyclone separator according to claim 8.

* * * * *